US008297081B2

(12) United States Patent
Zumloh-Nebe et al.

(10) Patent No.: US 8,297,081 B2
(45) Date of Patent: Oct. 30, 2012

(54) STAPLE FIBER YARN, METHOD FOR PRODUCING A TEXTILE ARTICLE, AND TEXTILE ARTICLE

(75) Inventors: Regine Maria Zumloh-Nebe, Wuppertal (DE); Christoph Jorg Hahn, Wuppertal (DE)

(73) Assignee: Teijin Aramid GmbH, Wuppertal (DE)

( * ) Notice: Subject to any disclaimer, the term of this patent is extended or adjusted under 35 U.S.C. 154(b) by 153 days.

(21) Appl. No.: 12/811,253

(22) PCT Filed: Jan. 5, 2009

(86) PCT No.: PCT/EP2009/050021

§ 371 (c)(1),
(2), (4) Date: Jun. 30, 2010

(87) PCT Pub. No.: WO2009/087123

PCT Pub. Date: Jul. 16, 2009

(65) Prior Publication Data

US 2010/0281923 A1 Nov. 11, 2010

(30) Foreign Application Priority Data

Jan. 10, 2008 (EP) ..... 08000338

(51) Int. Cl.
*D04B 39/00* (2006.01)

(52) U.S. Cl. ..... 66/202

(58) Field of Classification Search ..... 66/202; 28/271, 254; 428/267
See application file for complete search history.

(56) References Cited

U.S. PATENT DOCUMENTS

| | | | | |
|---|---|---|---|---|
| 6,602,600 | B2 * | 8/2003 | Zhu | 428/364 |
| 2002/0123284 | A1 * | 9/2002 | Zhu | 442/199 |
| 2003/0129395 | A1 * | 7/2003 | Zhu | 428/373 |
| 2007/0269654 | A1 * | 11/2007 | Veillat et al. | 428/364 |

FOREIGN PATENT DOCUMENTS

| | | | |
|---|---|---|---|
| EP | 1 862 572 | A1 | 12/2007 |
| WO | WO 00/08410 | | 2/2000 |
| WO | WO 02/052077 | A2 | 7/2002 |
| WO | WO 2004/033774 | A1 | 4/2004 |

OTHER PUBLICATIONS

International Search Report issued in corresponding International Application No. PCT/EP2009/050021, mailed Feb. 27, 2009. (with English-language translation).

* cited by examiner

*Primary Examiner* — Danny Worrell, Jr.
(74) *Attorney, Agent, or Firm* — Oliff & Berridge, PLC

(57) ABSTRACT

A staple fiber yarn having at least one twisted thread. The twisted thread includes a mixture of first staple fibers and second staple fibers. The first staple fibers are produced from high-strength filaments and the second staple fibers have a shrinkage in the range from 5% to 50%. The weight ratio of the first to second staple fibers lies in the range of 5:95 to 45:55. A method for producing a textile article wherein shrinkage is implemented either on the staple fiber yarn, after which the article is produced from the shrunken staple fiber yarn, or on the article containing the non-shrunken staple fiber yarn. The textile article has a wear resistance that is similarly high or indeed even higher than that of a correspondingly produced textile article, the staple fiber yarn of which consists exclusively of first staple fibers that are produced from high-strength filaments.

18 Claims, No Drawings

STAPLE FIBER YARN, METHOD FOR PRODUCING A TEXTILE ARTICLE, AND TEXTILE ARTICLE

TECHNICAL FIELD

The present invention relates to a staple fiber yarn, a method for producing a textile article, and a textile article.

BACKGROUND

Textile articles made of staple fiber yarn produced from aramid staple fibers are known from EP-A 1 099 088. Articles of this type, like gloves, have a high wear resistance and a high cut resistance, but they are, due to the high-cost aramid fibers processed therein, correspondingly expensive.

Therefore the object of the present invention is to make textile articles available that can be provided less expensively without, however, losing the wear resistance.

SUMMARY

This object is achieved by a staple fiber yarn comprising at least one twisted thread, wherein the twisted thread comprises a mixture of first staple fibers and second staple fibers, wherein the first staple fibers are produced from high-strength filaments that have a breaking tenacity of at least 80 cN/tex, the second staple fibers have a shrinkage in the range from 5% to 50%, the weight ratio of the first staple fibers to the second staple fibers in the at least one twisted thread is A:B and A:B lies in the range of 5:95 to 45:55.

The inventive staple fiber yarn can be processed into a textile article, wherein either the inventive staple fiber yarn is initially shrunk and then processed into the textile article or wherein a textile article is first produced from the inventive staple fiber yarn and this article is then shrunk.

DETAILED DESCRIPTION

Surprisingly, the textile article according to the invention has a wear resistance that is similar or even higher than that of a correspondingly produced textile article, the staple fiber yarn whereof consists exclusively of first staple fibers, wherein the inventive article, in view of its proportion of first staple fibers made of high-strength filaments, which due to the ratio A:B in the range from 5:95 to 45:55 is always smaller than the proportion of the second staple fibers, still has a cut resistance, the decrease therein being surprisingly small, in comparison to a comparison article which is produced exclusively from the first staple fibers made of high-strength filaments.

Therefore, the aforementioned method for producing a textile article and the textile article produced according to this method are part of the present invention.

Thus, the present invention for the first time makes textile articles available which—because the second staple fibers contained in the inventive article are significantly cheaper than the first staple fibers—can be offered at a correspondingly lower price. At the same time, in a certain embodiment of the inventive textile article, the wear resistance is increased by 81% while the cut resistance is only 11% lower than in a textile article produced in the same way from one staple fiber yarn, the staple fibers whereof consist exclusively of first staple fibers made of high-strength filaments (A:B=100:0).

The inventive staple fiber yarn comprises at least one twisted thread, wherein the twisted thread comprises a mixture of first and second staple fibers. This means that within the context of the present invention, in each volume unit of the inventive staple fiber yarn, an intimate mixture of the first and second staple fibers is present, such that the inventive staple fiber yarn is essentially free from all core-sheath structures in respect of the first and second staple fibers, and is preferably completely free from all core-sheath structures in respect of the first and second staple fibers.

The inventive staple fiber yarn comprises at least one twisted thread, which comprises first staple fibers, which are produced from high-strength filaments that have a breaking tenacity of at least 80 cN/tex. If the breaking tenacity is below 80 cN/tex, the cut resistance of the textile article produced from the inventive staple fiber yarn is too low. Preferably the first staple fibers of the inventive staple fiber yarn are produced from high-strength filaments that have a breaking tenacity of at least 120 cN/tex, particularly preferably of at least 150 cN/tex and more particularly preferably of 190 cN/tex.

The first staple fibers can be produced by tearing corresponding high-strength filaments, by which means first staple fibers with a length distribution attributable to the tearing process result. Alternatively, the first staple fibers can be produced by cutting corresponding high-strength filaments, by which means first staple fibers with a uniform length result, which length lies preferably in the range from 10 mm to 200 mm and more preferably in the range from 30 to 60 mm.

In a preferred embodiment of the inventive staple fiber yarn, the first staple fibers are selected from at least one of the groups comprising aramid staple fibers, polybenzoxazole staple fibers, and polybenzthiazole staple fibers. This means in the context of the present invention that the first staple fibers are selected either only from aramid staple fibers or only from polybenzoxazole staple fibers or only from polybenzthiazole staple fibers. This further means in the context of the present invention that the first staple fibers can also consist of a mixture of aramid staple fibers with polybenzoxazole and/or polybenzthiazole staple fibers.

Within the context of the present invention, aramid staple fibers means staple fibers that are produced from aramids, i.e. from aromatic polyamides, wherein at least 85% of the amide linkages (—CO—NH—) are attached directly to two aromatic rings. An aromatic polyamide particularly preferred for the present invention is polyparaphenylene terephthalamide, a homopolymer resulting from the mole-for-mole polymerization of paraphenylene diamine and terephthaloyl dichloride. In addition, copolymers are suitable as aromatic polyamides for the present invention that contain, in addition to paraphenylene diamine and terephthaloyl dichloride, minor amounts of other diamines and/or other dicarboxylic acid chlorides embedded in the polymer chain. As a general rule it is understood that, in relation to paraphenylene diamine and terephthaloyl dichloride, the other diamines and/or other dicarboxylic acid chlorides can be incorporated in the polymer chain at an amount of up to 10 mole percent.

In the inventive staple fiber yarn, the first staple fibers used therein, e.g. the aramid staple fibers as well, can thus be new staple fibers. However, in the inventive staple fiber yarn the first staple fibers used, e.g. the aramid staple fibers as well, can equally be made from up to 100 wt. % of recycled staple fibers.

Within the context of the present invention, polybenzoxazole staple fibers and polybenzthiazole staple fibers mean staple fibers that are produced from polybenzoxazoles or from polybenzthiazoles, i.e. from polymers having the structural units presented in the following, whereby the aromatic groups attached to the nitrogen are preferably carbocyclic, as shown in the structural units. However, said groups can also be heterocyclic. In addition, the aromatic groups attached to the nitrogen are preferably six-membered rings, as shown in the structural units. However, said groups can also be formed as fused or unfused polycyclic systems.

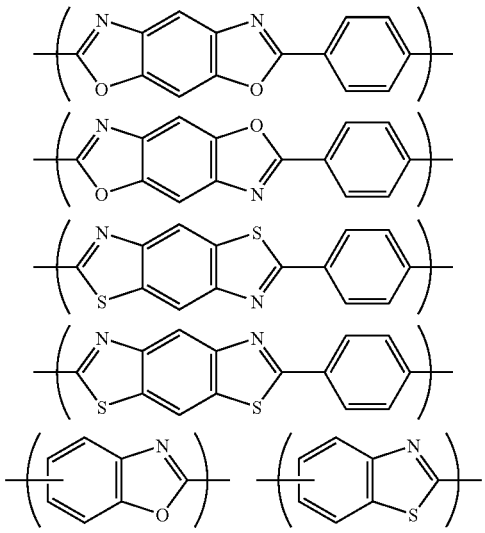

In a preferred embodiment, the inventive staple fiber yarn has first staple fibers with a linear density in the range from 0.1 dtex to 10 dtex, especially preferably in the range from 0.5 dtex to 5 dtex, and most especially in the range from 0.5 dtex to 2.5 dtex.

The inventive staple fiber yarn has second staple fibers which have a shrinkage in the range from 5% to 50%. If the shrinkage is below 5%, the cut resistance of the textile article produced from the inventive staple fiber yarn is too low. At a shrinkage above 50%, the shrunken textile article is too stiff and offers too little wear comfort.

Preferably the second staple fibers of the inventive staple fiber yarn have a shrinkage in the range from 7% to 40%, more preferably in the range from 8% to 35% and more particularly preferably in the range from 9% to 30%.

The second staple fibers can be produced by tearing corresponding filaments having the shrinkage required for the invention, by which means second staple fibers with a length distribution attributable to the tearing process result. Alternatively, the second staple fibers can be produced by cutting corresponding filaments having the shrinkage required for the invention, by which means second staple fibers with a uniform length result, which length lies preferably in the range from 10 mm to 200 mm and more preferably in the range from 30 to 60 mm.

In a further preferred embodiment of the inventive staple fiber yarn, the second staple fibers are thermoplastic staple fibers, which are preferably selected from at least one of the groups comprising polyacrylonitrile staple fibers and polyether ether ketone staple fibers. This means in the context of the present invention that the second staple fibers are preferably either selected only from polyacrylonitrile staple fibers or only from polyether ether ketone staple fibers. This further means in the context of the present invention that the second staple fibers in a further preferred embodiment can be made from a mixture of polyacrylonitrile staple fibers with polyether ether ketone staple fibers, wherein by increasing the proportion of polyether ether ketone staple fibers, the heat durability of the inventive textile article produced from the inventive staple fibers increases.

In the context of the present invention, polyacrylonitrile staple fibers mean staple fibers that are produced from a polymer that comprises at least 85 wt. % acrylonitrile units,

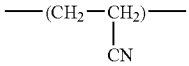

wherein the remaining up to 15 wt. % can be ethylenic monomers, which—individually or in the mixture—can be copolymerized with acrylonitrile, such as esters of acrylic acid and methacrylic acid (methyl acrylate, ethyl acrylate, methyl methacrylate, ethyl methacrylate, etc.), vinyl acetate, vinyl chloride, vinylidene chloride, acrylamide, methacrylamide, or methacrylonitrile.

In the context of the present invention, polyether ether ketone staple fibers mean staple fibers that are produced from a polymer, wherein phenyl groups are linked via ether groups and ketone groups in a sequence, wherein two ether linkages are followed by one ketone linkage.

In a preferred embodiment, the inventive staple fiber yarn has second staple fibers with a linear density in the range from 0.1 dtex to 20 dtex, more preferably in the range from 0.5 dtex to 5 dtex, and especially in the range from 0.9 dtex to 2.5 dtex.

The inventive staple fiber yarn comprises at least one twisted thread, preferably two or three or four twisted threads.

Each of the twisted threads of the inventive staple fiber yarn preferably has a linear density in the range from 100 dtex to 10,000 dtex, more preferably in a range from 120 dtex to 5000 dtex, and especially in a range from 200 dtex to 2000 dtex, and corresponding Nm values (Nm=1000/tex).

In a preferred embodiment of the inventive staple fiber yarn, A:B lies in the range from 10:90 to 40:60.

The inventive staple fiber yarn can in principle be produced by any method for producing a staple fiber yarn, e.g. by a method comprising the steps a) providing first and second staple fibers and, if necessary, additional staple fibers, wherein the first staple fibers are produced from high-strength filaments that have a breaking tenacity of at least 80 cN/tex, and wherein the second staple fibers have a shrinkage in the range from 5% to 50%,
b) mixing the first, second, and, if necessary, additional staple fibers by producing a sliver, wherein the mixing is implemented such that in each volume element of the inventive staple fiber yarn to be produced, an intimate mixing of the first, second, and, if necessary, additional staple fibers is present, so that the resulting inventive staple fiber yarn is essentially free from all core-sheath structures in respect of at least the first and second staple fibers, and wherein the weight ratio of first staple fibers:second staple fibers:additional staple fibers lies in the range of 5:95:0 to 45:55:0, preferably in the range of 5:90:5 to 40:60:0, and
c) spinning the sliver produced in step b) into at least one twisted thread.

In the course of this, the previously mentioned process characteristics have the corresponding meaning initially explained in the description of the inventive staple fiber yarn.

In the selection of the additional staple fibers used, if necessary, in the inventive method, it should be considered that the kind and quantity of additional staple fibers selected in step b) allow the achievement of the advantageous characteristics of the inventive staple fiber yarn in the respectively desired extent. If, for example, cotton, rayon, nylon, or other polyester staple fibers are used as the additional staple fibers, which fibers are either new or come from a recycling process, the weight ratio of said staple fibers in the mixture produced in step b) should not exceed a value of approx. 90 wt. %, preferably of approx. 80 wt. %, so that the weight ratio of first staple fibers:second staple fibers:additional staple fibers is in the specified cases e.g. 5:20:75 and 20:70:10.

If the inventive staple fiber yarn is produced without additional staple fibers, the weight ratio of first staple fibers: second staple fibers lies preferably in the range from 10:90 to 40:60.

The underlying object of the present invention is further achieved by a method for producing a textile article by using an inventive staple fiber yarn, wherein the method comprises shrinkage, and the shrinkage is implemented

- either on the staple fiber yarn, after which the article is produced from the shrunken staple fiber yarn,
- or on the article containing the non-shrunken staple fiber yarn.

In the inventive method, the shrinkage is implemented by heating the inventive staple fiber yarn at a shrinkage temperature $T_s$, which is above the glass temperature $T_g$ and below the melting temperature $T_m$ of the material which comprises the second staple fibers. In the process the shrinkage can be implemented in a dry, vapor-saturated, or wet atmosphere, i.e. as hot air, saturated steam, or boiling water shrinkage.

If the shrinkage of the inventive staple fiber yarn is implemented before it is processed into the inventive textile article, the inventive staple fiber yarn could be located during shrinkage on a spool which is located in one of the previously mentioned atmospheres. Alternatively, the inventive staple fiber yarn can be unwound from the spool and fed through one of the specified atmospheres.

If the shrinkage is implemented on the article containing the inventive staple fiber yarn, the inventive textile article which contains the inventive staple fiber yarn is placed in one of the specified atmospheres and the shrinkage of the inventive staple fiber yarn is triggered in the specified temperature range.

As previously mentioned, the shrinkage in the inventive method for producing a textile article is implemented at a shrinkage temperature $T_s$, which lies in the range $T_g<T_s<T_m$. For a number of the materials that form the second staple fibers, in particular for thermoplastic polymers, $T_s$ extends in a range from 100° C. to 150° C., especially in a range from 110° C. to 140° C., for which reason the specified ranges are preferred and more preferred, respectively, in the inventive method.

So that the shrinkage occurs in sufficient measure in the inventive method for producing the inventive textile article, a shrinkage time $t_s$ in the range of 20 seconds to 700 seconds, especially from 30 seconds to 240 seconds, and more particularly preferably from 50 seconds to 180 seconds suffices for a plurality of materials which form the second staple fibers, especially for thermoplastic polymers.

The use of the inventive staple fiber yarn in the inventive method for producing a textile article can occur in the form of any one of the known methods by means of which textile articles are produced from staple fiber yarns, preferably, however, by knitting, crocheting, plaiting, or weaving.

If the inventive method for producing a textile article using the inventive staple fiber yarn occurs by means of knitting, then the knitting takes place preferably using a needle gauge of 7 gg to 18 gg (1 gg means 1 stitch per 2.54 cm) and a mesh density in courses in the range from 3 per cm to 12 per cm and in wales in the range from 3 per cm to 12 per cm.

In the production of the inventive article, the inventive staple fiber yarn made of only one twisted thread can, for example, be fed into e.g. a knitting, crocheting, plaiting, or weaving device. However, an inventive staple fiber yarn made of two or three or four twisted threads can also be fed into one of the aforementioned devices, wherein the two, three, or four twisted threads can be fed in parallel into the device. Alternatively, the two, three, or four twisted threads can be first twisted about each other and then fed into the device which manufactures the inventive textile article.

The underlying object of the present invention is finally achieved by a textile article which is manufactured according to the inventive method.

In preferred embodiments, the inventive textile article is a glove, an apron, a pair of pants, a jacket, a sleeve, a hose, a hose jacket, or a vandalism-resistant article.

EXAMPLES

The present invention will now be described in more detail in the following examples:

Example 1a 50 mm long p-aramid staple fibers (type 1072, Teijin Aramid) are provided as first staple fibers, which are produced by cutting p-aramid filament yarn (type 1012, Teijin Aramid) having a filament linear density of 1.7 dtex.

50 mm long polyacrylonitrile staple fibers (type SHK 1.3/50, Dyvertex) are provided as second staple fibers, which are produced by cutting polyacrylonitrile filament yarn having a filament linear density of 1.3 dtex. The polyacrylonitrile staple fibers have, according to DIN 53866, part 3 (March 1979), 19.1% measured shrinkage at a shrinkage time of 15 minutes, a shrinkage temperature of 190° C. and with a pretensioning of 240 mg.

30 parts by weight of the first staple fiber are intimately mixed with 70 parts by weight of the second staple fiber using sliver mixing, and a staple fiber yarn is produced that comprises a twisted thread with Nm 28/1 (36 dtex). Four of these threads are twisted around each other, fed into a knitting machine and knitted into a glove, wherein the needle gauge is 7 gg (7 stitches per 2.54 cm), the mesh density of the glove prior to shrinkage is 3.5 per cm in courses and 3.5 per cm in wales.

Example 1b

Example 1b is implemented like example 1a, with the difference that during the production of the glove a twisted thread having Nm 28/1 (36 dtex) is fed into the knitting machine, the needle gauge is 13 gg (13 stitches per 2.54 cm) and the mesh density of the glove prior to shrinkage is 8 per cm in courses and 6 per cm in wales.

Comparison Example V1

50 mm long p-aramid staple fibers (type 1072, Teijin Aramid) are produced by cutting p-aramid filament yarn (type 1012, Teijin Aramid) having a filament linear density of 1.7 dtex.

A staple fiber yarn is produced from the above-mentioned staple fibers that comprises a twisted thread having Nm 28/1 (36 dtex). Four of these threads are twisted around each other, fed into a knitting machine and knitted into a glove, wherein the needle gauge is 7 gg (7 stitches per 2.54 cm) and the mesh density is 3.5 per cm in courses and 3.5 per cm in wales.

Comparison Example V2

Comparison example V2 is implemented like comparison example V1, with the difference that a twisted thread is fed into the knitting machine, the needle gauge is 13 gg and the mesh density is 8 per cm in courses and 6 per cm in wales.

The lowest individual cut index, NESI, and the wear resistance as the number of revolutions until a hole is formed, TZ, were determined according to EN 388 for the inventive gloves produced according to examples 1a-b and for the comparison gloves produced according to comparison examples V1 and V2. Afterwards, the gloves produced according to the invention were shrunken in a hot-air oven at a shrinkage temperature $T_s$=130° C. for a shrinkage time $t_s$=120 seconds, and the NESI and TZ were measured again.

The results are summarized in the following table. NB therein indicates the weight ratio of p-aramid staple fibers: polyacrylonitrile staple fibers in the inventive staple fiber yarn, gg indicates the needle gauge of the knitting machine, NESI non-shrunken and shrunken indicates the lowest individual cut index, i.e. the cut resistance before and after shrinkage, and TZ non-shrunken and shrunken the number of rotations until a hole is formed, indicating wear resistance before and after shrinkage.

| Examples | A:B | gg | NESI non-shrunken | NESI shrunken | TZ non-shrunken | TZ shrunken |
|---|---|---|---|---|---|---|
| 1a | 30:70 | 7 | 2.8 | 5.7 | 406 | 904 |
| 1b | 30:70 | 13 | 2.5 | 1.8 | 96 | 202 |
| V1 | 100:0 | 7 | 6.4 | — | 500 | — |
| V2 | 100:0 | 13 | 2.7 | — | 200 | — |

The comparison of example 1a with comparison example V1 shows that the inventive glove, which was produced using the inventive staple fiber yarn and shrunken, has a cut resistance that is only 11% lower and a wear resistance that is 81% higher than the comparison glove, even though 70% of the p-aramid staple fibers were replaced by polyacrylonitrile staple fibers in the staple fiber yarn of the inventive glove.

The comparison of example 1b with comparison example V2 shows that the inventive glove, which was produced using the inventive staple fiber yarn and shrunken, has a cut resistance that is indeed 33% lower; however the wear resistance is practically identical to the comparison glove, even though 70% of the p-aramid staple fibers were replaced by polyacrylonitrile fibers in the staple fiber yarn of the inventive glove.

The invention claimed is:

1. A staple fiber yarn comprising:

at least one twisted thread, the twisted thread comprises a mixture of first staple fibers and second staple fibers, wherein the first staple fibers are produced from high-strength filaments that have a breaking tenacity of at least 80 cN/tex, the second staple fibers have a shrinkage in the range from 5% to 50%, and the weight ratio of the first staple fibers to the second staple fibers in the at least one twisted thread is A:B and A:B lies in the range of 5:95 to 45:55.

2. The staple fiber yarn of claim 1, wherein the first staple fibers are produced from high-strength filaments that have a breaking tenacity of at least 120 cN/tex.

3. The staple fiber yarn of claim 1, wherein the first staple fibers are selected from at least one of the groups consisting of aramid staple fibers, polybenzoxazole staple fibers, and polybenzthiazole staple fibers.

4. The staple fiber yarn of claim 1, wherein the first staple fibers have a linear density in the range from 0.1 dtex to 10 dtex.

5. The staple fiber yarn of claim 1, wherein the second staple fibers have a shrinkage in the range from 7% to 40%.

6. The staple fiber yarn of claim 1, wherein the second staple fibers are thermoplastic staple fibers.

7. The staple fiber yarn of claim 4, wherein the second staple fibers have a linear density in the range from 0.1 dtex to 20 dtex.

8. The staple fiber yarn of claim 1, wherein the staple fiber yarn comprises two or three or four twisted threads.

9. The staple fiber yarn of claim 8, wherein each of the twisted threads has a linear density in the range from 100 dtex to 10,000 dtex.

10. The staple fiber yarn of claim 1, wherein the weight ratio A:B of first staple fibers:second staple fibers lies in the range from 10:90 to 40:60.

11. A method for producing a textile article comprising a staple fiber yarn, wherein the staple fiber yarn comprises:

at least one twisted thread, the twisted thread comprises a mixture of first staple fibers and second staple fibers, wherein the first staple fibers are produced from high-strength filaments that have a breaking tenacity of at least 80 cN/tex, the second staple fibers have a shrinkage in the range from 5% to 50%, and the weight ratio of the first staple fibers to the second staple fibers in the at least one twisted thread is A:B and A:B lies in the range of 5:95 to 45:55, and the method comprising a step of implementing shrinkage, wherein the shrinkage is implemented on either the staple fiber yarn, after which the article is produced from the shrunken staple fiber yarn, or the article containing the non-shrunken staple fiber yarn.

12. The method of claim 11, wherein the shrinkage is implemented at a shrinkage temperature $T_s$ in the range from 100° C. to 150° C.

13. The method of claim 11, wherein the shrinkage is implemented for a shrinkage time $t_s$ of 20 seconds to 700 seconds.

14. The method of claim 11, wherein the article is produced by knitting, crocheting, plaiting, or weaving.

15. The method of claim 14, wherein the knitting occurs using a needle gauge from 7 gg to 18 gg and a mesh density in the range of 3 per cm to 12 per cm in the courses and in the range of 3 per cm to 12 per cm in the wales.

16. A textile article produced according to the method of claim 11.

17. The textile article of claim 16, wherein the textile article is a glove, an apron, a pair of pants, a jacket, a sleeve, a hose, a hose jacket, or a vandalism-resistant article.

18. A staple fiber yarn comprising:

at least one twisted thread, the twisted thread comprises a mixture of first staple fibers and second staple fibers, wherein the first staple fibers are produced from high-strength filaments that have a breaking tenacity of at least 80 cN/tex, the second staple fibers have a shrinkage in the range from 5% to 50%, and the weight ratio of the first staple fibers to the second staple fibers in the at least one twisted thread is A:B and A:B lies in the range of 5:95 to 45:55, and the second staple fibers are thermoplastic staple fibers selected from at least one of polyacrylonitrile staple fibers and polyether ether ketone staple fibers.

* * * * *